United States Patent [19]

Niedecker

[11] 4,131,975

[45] Jan. 2, 1979

[54] CLIP

[76] Inventor: Herbert Niedecker, Am Ellerhang 6, 6240 Königstein 2, Germany

[21] Appl. No.: 766,415

[22] Filed: Feb. 7, 1977

[30] Foreign Application Priority Data

Feb. 13, 1976 [DE] Fed. Rep. of Germany ..... 2605671

[51] Int. Cl.[2] ..... B65D 77/18

[52] U.S. Cl. ..... 24/30.5 W; 24/115 A; 85/49; 229/65

[58] Field of Search ..... 24/30.5 R, 30.5 W, 27, 24/20 R, 20 CW, 115 A; 85/19, 49, 31; 229/62, 65

[56] References Cited

U.S. PATENT DOCUMENTS

| | | | |
|---|---|---|---|
| 3,141,221 | 7/1964 | Faulls, Jr. | 24/30.5 R |
| 3,165,801 | 1/1965 | Stansbury, Jr. et al. | 24/30.5 R X |
| 3,400,433 | 9/1968 | Klenz | 24/30.5 W |
| 3,473,430 | 10/1969 | Niedecker | 24/30.5 W |
| 3,564,663 | 2/1971 | Roberts | 24/30.5 W |

FOREIGN PATENT DOCUMENTS

| | | | |
|---|---|---|---|
| 1199686 | 3/1960 | Fed. Rep. of Germany | 24/30.5 W |
| 2461175 | 6/1976 | Fed. Rep. of Germany | 24/30.5 W |

*Primary Examiner*—Werner H. Schroeder
*Assistant Examiner*—Moshe I. Cohen
*Attorney, Agent, or Firm*—Sprung, Felfe, Horn, Lynch & Kramer

[57] ABSTRACT

A U-shaped clip intended to be deformed to enclose and close the mouth of a flexible tube or bag, comprising a pair of limbs of substantially constant cross-section and a web joined to the limbs, respectively at a pair of transition points, the cross-sections of the web and transition points differing from and having a higher section modulus than the cross-section of the limbs. Advantageously the limbs are round in cross-section and the web at the middle is rectangular with rounded corners, the web changing in cross-section gradually from the middle to the transition points. Indentations may be provided on the outside of the limbs near their ends to facilitate buckling of the limbs toward one another when the clip is worked upon by a closing tool. The clips are assembled one behind the other with their limbs forming two parallel lines, constituting a magazine for supply to the closing tool.

8 Claims, 9 Drawing Figures

CLIP

This invention relates to a U-shaped clip which is intended to close bags, flexible tubes or the like and has been made from a piece of wire which is constant in cross-section throughout its length.

There are two basic types of clips which are intended to close bags, flexible tubes or the like. Clips of one kind are made in that strip material is shaped by embossing operations, in most cases in several stages, to form clips, which are joined in a strip to form a supply of clips, which in this form are introduced into the closing machine, in which each clip is severed from the strip immediately before the closing operation. The embossing or other shaping tools may be designed so that the shaped clip has a cross-sectional shape which is suitable with a view to the intended purpose. The clips may have different cross-sectional shapes in the limbs and web (see, e.g., Printed German Application No. 1,761,616).

Clips of the other basic kind are made from wire material, which is cut into pieces, which are shaped to a clip. These clips are in most cases U-shaped. In this shaping operation the cross-section of the piece of wire remains constant throughout its length, apart from the upsetting and stretching of the material due to the bending. The starting material is in most cases circular in cross-section or has other cross-sectional shapes with a view to special applications (see, e.g., Opened German Specifications Nos. 1,536,183 and 1,959,755). A supply of clips of this kind is formed in that a plurality of individual clips are juxtaposed with the same orientation and are joined by means of adhesive material or the like to form a "bar".

When a flexible packaging tube is to be closed with a U-shaped clip, the tube is gathered and is then embraced with the clip. The two open limbs of the U-shaped clip are then bent inwardly on a concave die, which has one or more slide grooves. As a result, the end of the casing is firmly closed. To avoid a spontaneous opening of the clip, it must resist the static restoring force which is exerted by the closed end. In some cases, a liquid-tight, fat-tight or air-tight seal is required.

It has now been found in practice that the clips of the last-mentioned kind have certain disadvantages. Particularly the behavior of said clips during and after the closing operation is often unsatisfactory. Filled bags and flexible tubes are usually closed by a machine in an operation in which a punch pushes the clip over the gathered end portion of a flexible tube and drives the clip onto the die. In this operation the limb ends in one slide groove or in two parallel slide grooves until the end portions of the tube is firmly embraced. The end faces of the limb ends may either form a butt joint or the grooves may be so designed that these end faces move past one another.

The limbs ends will most effectively resist the restoring force exerted by the closed end of the casing if they extend as exactly parallel as possible to the web of the clip when the same is in its final position, and it would even be desirable to give a slight bend to the limb ends. Whereas it has been attempted to provide for this desired bend in that the U-shaped clip is slightly bent inwardly before or is beveled on the outside, both measures have proved unsatisfactory. Prebending results in a decrease of the open cross-sectional area so that larger clips, which involve a higher expenditure of material, are required for a given cross-section to be closed. The ends of such clips are often reversely bent inwardly to an excessively large extent so that they damage the gathered casing. In the use of clips having beveled limb ends it has been found that the inside surfaces of the limb ends were not bent inwardly to a sufficiently large extent opposite to the bevels so that a sufficiently large closing pressure often cannot be applied in this region. This may result in an uncontrolled opening of the closure and consequently in a loss or spoiling of the content.

To ensure that the plastic deformation of the clip can be initiated without upsetting when the limb ends have engaged the die, that region of the latter which is initially engaged by the leg ends must be sufficiently steep, but this would result in the disadvantage that the closed clip would not have the desired shape. The flatter the portion of the die which is initially engaged by the clip, the higher is the risk that the clip is upset during its plastic deformation. It is not possible to adopt a compromise in designing the die. When prebent or beveled limb ends suddenly engage the die, the clips are also upset and/or improperly bent so that trouble arises in the operation of the closing machines and unsatisfactory closures result. This result has not been substantially improved even by the application of a suitable lubricant to the end face of the limb ends.

For this reason it is an object of the invention to provide a clip which is of the kind defined first hereinbefore and which is improved in that its limbs can be bent inwardly more easily and more reliably during the closing operation, that perfectly tight closures are obtained, and that damage to the bags, flexible tubes or the like is avoided. At the same time, the manufacturing costs should not be increased or should not be substantially increased.

Surprisingly it has been found that a clip of the kind defined first hereinbefore can be much improved in that it has a higher section modulus, as a result of a change in cross-section, in its web and at the transitions to the limbs.

The clips of the kind defined first hereinbefore are made from a piece of wire which is constant in cross-section throughout its length although various portions of the shaped clip and the closed clip are subjected to stresses of different magnitude and intended to perform different functions. For a clip of a certain size, the diameter of the wire is selected so that its cross-section is sufficient for that portion of the clip which is to be subjected to the highest stress. Other portions are more or less excessively large in cross-sectional area so that the expenditure of material is higher than required.

If the cross-sectional shape is changed in the web and its transitions to the limbs, in accordance with the invention, less material will be required to make a clip having a given size or a clip which is capable of exerting a stronger closing force can be made with a given expenditure of material. The higher section modulus provided according to the invention in the stated regions does not only result in the required higher stiffness of the clip in said regions but has also the result that those portions of the clip which have been changed in cross-section bear on the casing with an area which is narrower than the bearing area of the portions which have not been changed in cross-section, e.g., at the limbs. As a result, the local closing pressure is increased and the risk of a slipping of the clip from the casing is reduced. Besides, a certain asymmetry of the local closing pressure results because a lower local closing pressure is applied to those portions of the casing which face the limb portions that have not been changed in cross-section. Under a load near the highest permissible load, a slippage may begin in this area when the clip still adheres firmly on the opposite side of the casing. As a result, the clip is tilted about the center line of the clipped portion of the casing so that a further slippage is immediately prevented. The closing force exerted by the clip according to the invention has been ascertained in tests which have simulated practical conditions. In these tests it has been found that the feared slipping is absolutely avoided and that the application of the higher testing pressure may rather result in a bursting of the bags, flexible tubes or the like.

According to a preferred feature of the invention, that portion in which the cross-section is to be changed is shaped to a cross-sectional configuration of a rectangle having rounded corners or approximately of a rhombus. Besides, the portion which has been changed in cross-section may contain less material in the neutral zone than in the regions which are to be stressed in tension and compression, respectively.

Within the scope of the invention, the change in cross-section may be most pronounced in the middle of the web and may decrease continuously to the unchanged cross-section of the limbs.

A further improvement of the clip will be obtained in that the limbs are provided with portions which are decreased in cross-section to define rated buckling points.

Further details and advantages will be explained more fully with reference to embodiments shown by way of example in the drawing, wherein:

FIGS. 1*a* and *b* show a clip according to the invention in elevation and section, respectively;

FIGS. 2*a* and *b* show two embodiments of rated buckling points or indentations in sectional views;

Figure 1:
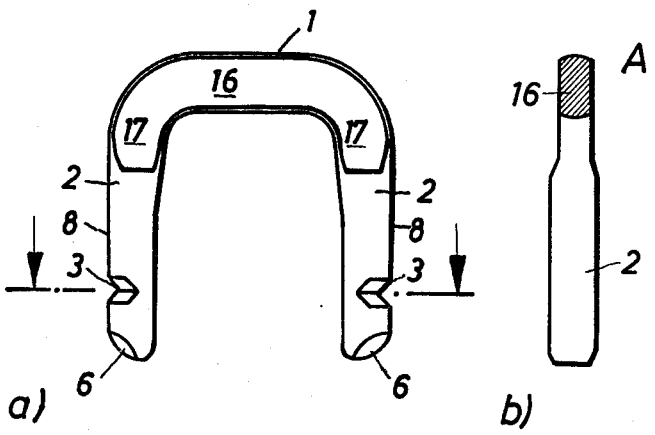

Referring now more particularly to the drawing, FIGS. 1*a* and 1*b* show a U-shaped clip 1, which has been made from a piece of wire that is circular in cross-section. In a web 16 and at transitions 17 between the web and limbs 2, this cross-section has been changed to a configuration which approximates a rectangle having rounded corners (Form A) by a pressing or embossing operation. At a certain distance from its free end, each limb 2 is provided on its outside 8 with a rated buckling point 3, at which the original cross-section 7 (See FIG. 2) has been locally decreased.

Figure 2:
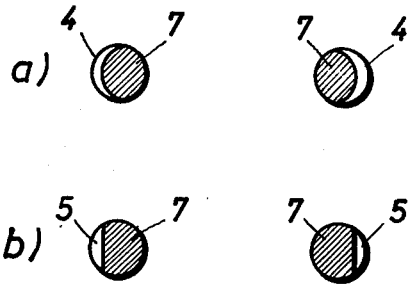

FIG. 2 shows two different rated buckling points 3 in sectional views. The rated buckling point 3 is provided in accordance with FIG. 2*a* by a crescent-shaped recess 4 and in accordance with FIG. 2*b* by a prismatic recess 5. It is apparent that the originally circular cross-section 7 has been weakened by the recess 4 or 5 in both cases.

Figure 3:
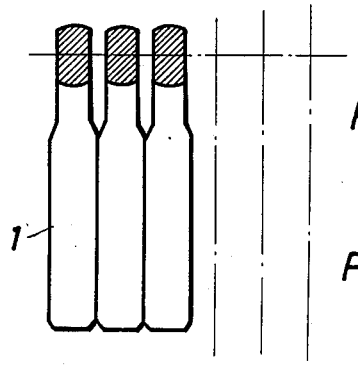
FIG. 3 shows a plurality of aligned clips.

FIG. 3 shows how clips 1 according to the invention may be juxtaposed to form an assembly or magazine of such clips with their limbs forming two parallel lines, particularly suited for supply to a closing tool.

Figure 4:
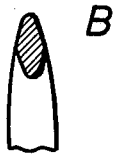
FIGS. 4 and 5 show modified cross-sectional shapes of the web at its middle.

FIG. 4 shows a clip (Form B) whose web at its midpoint is rhombic in cross-section.

Figure 5:
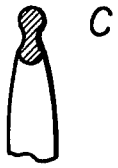

The web in FIG. 5 (Form C) is dumbbell shaped in cross-section.

Figure 6:
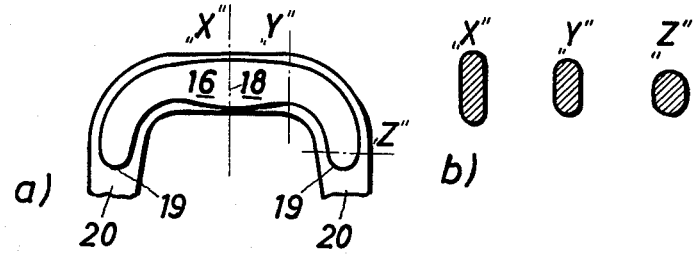
FIG. 6*a* shows an elevation of a clip which embodies a gradual change in cross-section.
FIG. 6*b* shows the cross-section of the clip at three different locations X, Y and Z.

A further embodiment of the invention is shown in FIG. 6. In this embodiment the change in cross-section is not the same in all portions but is most pronounced in the middle 18 of the web 16 and decreases continuously to the transition 19 to the unchanged limb cross-section 20. FIG. 6*a* is a fragmentary elevation showing the clip according to the invention. FIG. 6*b* represents three different cross-sectional shapes in sectional views taken on lines "x", "y" and "z" in FIG. 6*a*. If properly designed tools are used, this concept may also be adopted in conjunction with the cross-sectional shapes as shown in FIGS. 4 and 5. Numerous other embodiments are possible within the concept of the invention, provided that the section modulus of the clip is increased by a change in cross-section with a view to the loads to be encountered in use. In each case, the selection of the changed cross-sectional shape and of the extent of the change will be guided by the local stresses to be expected, on the one hand, and the manufacturing costs involved in the change in cross-section.

It will be appreciated that the instant specification and examples are set forth by way of illustration and not limitation, and that various modifications and changes may be made without departing from the spirit and scope of the present invention.

What is claimed is:

1. A U-shaped wire clip intended to be permanently deformed to enclose and close the mouth of a flexible tube or bag, comprising a pair of limbs of substantially constant cross-section and a web joined to the limbs at a pair of transition points, the cross-sections of the web and transition points differing from and having a higher section modulus than the cross-section of the limbs, the cross-sectional areas of the web, transition points and limbs being substantially constant.

2. A clip according to claim 1, wherein the cross-section of the limbs is approximately circular and that of the web and transition points is approximately rectangular with rounded corners.

3. A clip according to claim 1, wherein the cross-section of the limbs is approximately circular and that of the web and transition points is approximately rhombic.

4. A clip according to claim 1, wherein the cross-section of the limbs is approximately circular and that of the web and transition points is approximately dumbbell shaped.

5. A clip according to claim 1, wherein the cross-section of the limbs is approximately circular and the cross-section of the web is most out-of-round midway between limbs, the cross-section of the web changing gradually from the midway position to the transition points.

6. A clip according to claim 1, wherein the limbs are provided with indentations toward their ends which indentations are on the outsides of the limbs facing away from one another, thereby facilitating buckling of the limbs toward one another when worked upon by a closing tool.

7. A clip according to claim 6, wherein the cross-section of the limbs is approximately circular, and the cross-section of the web midway between the limbs is approximately rectangular with rounded corners, the cross-section of the web is most out-of-round midway between limbs, the cross-section of the web changing gradually from the midway position to the transition points.

8. An assembly of clips according to claim 1 arranged one behind the other with their limbs forming two parallel lines.

* * * * *